US010716369B2

(12) United States Patent
Tobiassen et al.

(10) Patent No.: US 10,716,369 B2
(45) Date of Patent: Jul. 21, 2020

(54) STRAP ARRANGEMENT

(71) Applicant: CONTINYOU AS, Sandnes (NO)

(72) Inventors: Terje Tobiassen, Kleppe (NO); Glenn Arild Haugland, Randaberg (NO)

(73) Assignee: CONTINYOU AS, Sandnes (NO)

( * ) Notice: Subject to any disclaimer, the term of this patent is extended or adjusted under 35 U.S.C. 154(b) by 0 days.

(21) Appl. No.: 16/337,098

(22) PCT Filed: Oct. 3, 2017

(86) PCT No.: PCT/EP2017/075050
§ 371 (c)(1),
(2) Date: Mar. 27, 2019

(87) PCT Pub. No.: WO2018/065398
PCT Pub. Date: Apr. 12, 2018

(65) Prior Publication Data

US 2020/0029661 A1 Jan. 30, 2020

(30) Foreign Application Priority Data

Oct. 6, 2016 (EP) ..... 16192618.3

(51) Int. Cl.
*A44C 5/20* (2006.01)
*A44C 5/14* (2006.01)

(52) U.S. Cl.
CPC ..... *A44C 5/2066* (2013.01); *A44C 5/147* (2013.01); *A44D 2203/00* (2013.01)

(58) Field of Classification Search
CPC ..... A44C 5/147; A44C 5/18; A44C 5/2066; A44C 5/2071; A44C 5/22; A44D 2203/00
See application file for complete search history.

(56) References Cited

U.S. PATENT DOCUMENTS 3,376,616 A 4/1968 John
4,941,236 A 7/1990 Sherman et al.
(Continued)

FOREIGN PATENT DOCUMENTS

CH 596786 3/1978
DE 202015005547 U1 11/2015
(Continued)

OTHER PUBLICATIONS

PCT International Preliminary Report on Patentability (IPRP) dated Jan. 4, 2019 for International Application Na PCT/EP2017/075050, 15 pages.
(Continued)

*Primary Examiner* — Robert Sandy
*Assistant Examiner* — David M Upchurch
(74) *Attorney, Agent, or Firm* — RMCK Law Group, PLC

(57) ABSTRACT

Strap arrangement comprising a first strap portion comprising a plurality of strap engaging structures, each strap engaging structure defines a size of an opening of the strap arrangement; a flexible second strap portion comprising at least one locking piece, the locking piece comprising at least one locking piece engaging structure for being aligned with at least one of the strap engaging structures; and at least one magnet adapted to force the locking piece engaging structure against at least one of the strap engaging structures by a magnetic force.

14 Claims, 4 Drawing Sheets

(56) References Cited

U.S. PATENT DOCUMENTS

| | | | | |
|---|---|---|---|---|
| 4,977,614 | A * | 12/1990 | Kurcbart | A44C 5/00 340/7.63 |
| 5,134,724 | A * | 7/1992 | Gehring | H01Q 1/273 340/7.63 |
| 5,179,733 | A * | 1/1993 | Matsui | H01Q 1/273 368/282 |
| 8,029,185 | B2 * | 10/2011 | Faucher | A44C 5/147 224/164 |
| 9,052,695 | B1 * | 6/2015 | Fedan | G04B 37/1486 |
| 9,826,789 | B2 | 11/2017 | Dey et al. | |
| 9,848,776 | B2 * | 12/2017 | Proud | H02J 50/10 |
| 10,492,574 | B2 * | 12/2019 | de Iuliis | G04B 37/1493 |
| 2005/0102802 | A1 * | 5/2005 | Sitbon | A41F 1/002 24/303 |
| 2013/0326790 | A1 | 12/2013 | Cauwels et al. | |
| 2016/0007697 | A1 * | 1/2016 | De Jong | A44C 5/2071 361/679.03 |
| 2018/0042368 | A1 * | 2/2018 | Mayer | A45F 5/00 |

FOREIGN PATENT DOCUMENTS

| | | | |
|---|---|---|---|
| EP | 3288000 | A1 | 2/2018 |
| GB | 2355281 | A | 4/2001 |
| WO | 03056956 | A2 | 7/2003 |

OTHER PUBLICATIONS

PCT International Search Report and Written Opinion dated Dec. 22, 2017 for International Application No. PCT/EP2017/075050, 9 pages.

* cited by examiner

STRAP ARRANGEMENT

CROSS-REFERENCE TO RELATED APPLICATIONS

This application is a 371 U.S. National Stage of International Application No. PCT/EP2017/075050, filed Oct. 3, 2017, which claims priority to European Patent Application No. 16192618.3, filed Oct. 6, 2016. The disclosures of each of the above applications are incorporated herein by reference in their entirety.

TECHNICAL FIELD

The present disclosure generally relates to a strap arrangement. In particular, a strap arrangement comprising a locking piece engaging structure, a plurality of strap engaging structures and a magnet for forcing the locking piece engaging structure against at least one of the strap engaging structures, and a wearable device comprising a watch and a strap arrangement, are provided.

BACKGROUND

Various types of strap arrangements with adjustable openings for attaching to objects of different sizes are known. One example is a strap arrangement for a wearable device where the strap arrangement can be adjusted to provide a selected opening for attachment to a limb of a user, e.g. a wristwatch comprising a strap arrangement.

Many strap arrangements are difficult to adjust, open and close with a desired opening of the strap arrangement. This can for example be troublesome for elderly or disabled persons. Further drawbacks with prior art strap arrangements include complicated designs, discomfort (e.g. due to sharp edges in the strap arrangement) and hygienically bad designs (e.g. strap arrangements including structured surfaces where bacteria and dust risk to adhere).

Non-published European patent application 161856034.4 describes a wearable device in the form of a watch.

SUMMARY

One object of the present disclosure is to provide a strap arrangement having a simple design, which can preferably be opened, closed and adjusted by one hand.

A further object of the present disclosure is to provide a strap arrangement enabling a simple and reliable operation, such as opening, closing and adjusting the strap arrangement.

A still further object of the present disclosure is to provide a comfortable strap arrangement.

A still further object of the present disclosure is to provide a strap arrangement having a hygienic design.

According to one aspect, there is provided a strap arrangement comprising a first strap portion comprising a plurality of strap engaging structures, each strap engaging structure defines a size of an opening of the strap arrangement; a flexible second strap portion comprising at least one locking piece, the locking piece comprising at least one locking piece engaging structure for being aligned with at least one of the strap engaging structures; and at least one magnet adapted to force the locking piece engaging structure against at least one of the strap engaging structures by a magnetic force. The at least one magnet may for example be comprised by, or constituted by, the locking piece and/or by the first strap portion.

The second strap portion may comprise only one locking piece. As an alternative, the second strap portion may comprise several locking pieces, such as two locking pieces. The addition of further locking pieces may increase the locking strength or provide flexibility, especially in cases were fewer strap engaging structures are provided. In case several locking pieces are provided, the locking piece engaging structure of each locking piece may be aligned with a unique strap engaging structure.

The strap arrangement according to the present disclosure may be constituted by a strap arrangement for a wearable device. A wearable device may be any type of device for being worn by a user (person or animal) that can be attached directly or indirectly to a body part of the user, e.g. a leg, an ankle, an arm (lower and upper arm), a finger, a wrist, or a waist. However, the strap arrangement according to the present disclosure may for example also be used as an industry fastener.

The second strap portion may be made flexible in various ways. For example, the second strap portion may be made of rubber, silicone rubber, textile or hinged or woven metal.

In contrast to the flexible second strap portion, the first strap portion may be rigid or substantially rigid. For example, the first strap portion may be formed of rigid plastics, e.g. injection moulded PET (Polyethylene Terephthalate). However, the first strap portion may alternatively be flexible.

According to one variant, the first strap portion and the second strap portions may constitute continuous portions of one single strap. As an alternative, the first strap portion and the second strap portion may constitute distinct strap portions, for example detachable and/or hingedly connected strap portions. The second strap portion may partially overlap the first strap portion, e.g. on an outer side of the first strap portion.

The degree of overlap depends on the selected size of the opening of the strap arrangement, i.e. with which locking strap engaging structure the locking piece engaging structure is aligned. For this reason, the second strap portion may alternatively be referred to as a size adjustment strap portion.

When the locking piece engaging structure is aligned with one of the strap engaging structures, the strap arrangement may be said to be in an engaged state, closed state or wrapped state where the strap arrangement is attached to a body part of a user, e.g. a leg, an ankle, an arm (lower and upper arm), a finger, a wrist, or a waist. When the locking piece engaging structure is not aligned with one of the strap engaging structures, the strap arrangement may be said to be in a disengaged state, open state or unwrapped state where the strap arrangement is allowed to be removed from or put on the body part.

In order to arrange the at least one magnet to force the locking piece engaging structure against at least one of the strap engaging structures by a magnetic force, the magnetic force may be an attracting magnetic force. It may however also be possible to force the locking piece engaging structure against the at least one of the strap engaging structures by employing a repelling magnetic force. The skilled person is well familiar with how to design magnets to establish attracting or repelling magnetic forces between two parts.

The first strap portion may comprise at least two strap engaging structures, such as two, three, four, five or more strap engaging structures. For example, in case the first strap portion comprises four strap engaging structures, the strap arrangement may be brought into four different engaged states by aligning the locking piece engaging structure with any of the four strap engaging structures. When the locking piece engaging structure is not aligned with any of the strap engaging structure, the locking piece can be moved away from the first strap portion (either by overcoming a magnetic force and/or by deactivating an electromagnet) such that the strap arrangement is brought into the disengaged state. By moving the locking piece engaging structure away from the strap engaging structure, the part of the opening of the strap arrangement defined by the second strap portion can be expanded.

In case an electromagnet is employed to establish the magnetic force between the locking piece and the first strap portion, the electromagnet can be remotely controlled, e.g. from an electronic device to which the strap arrangement is attached or from a unit separate from the strap arrangement. A remote control for unlocking the strap arrangement may for example be used if persons with dementia is supposed to wear a watch (attached to the strap arrangement) at all times.

When adopting any of the engaged states, the locking piece may be arranged outside of the first strap portion. An outer direction within the context of the present disclosure is a radially outer direction with respect to a through axis of the opening of the strap arrangement.

The locking piece may for example have a dimension along a local circumferential direction of the strap arrangement of 5 mm to 30 mm, such as 8 mm to 12 mm, such as 10 mm. The thickness of the locking piece may for example be 1 mm to 7 mm, such as 2 mm to 4 mm, such as 3 mm.

According to one variant, the one or more locking pieces are adjustably located along the second strap portion. In other words, each locking piece may be fastened to a particular section of the second strap portion, then released and moved in the extension direction of the second strap portion to a further section of the second strap portion where it is fastened. For this purpose, the locking piece may comprise a locking mechanism for releasably locking the locking piece to several positions along the second strap portion. In this manner, the number of realizable sizes of the opening of the strap arrangement can be drastically increased.

In case the one or more locking pieces are adjustably located along the second strap portion, there may be provided an alternative strap arrangement comprising a first strap portion comprising a single strap engaging structure, the strap engaging structure defines a size of an opening of the strap arrangement; a flexible second strap portion comprising at least one locking piece, the locking piece comprising at least one locking piece engaging structure for being aligned with the strap engaging structure; and at least one magnet adapted to force the locking piece engaging structure against the strap engaging structure by a magnetic force.

The plurality of strap engaging structures may be constituted by strap mating surfaces and the locking piece engaging structure may be constituted by a locking piece mating surface adapted to mate with at least one of the strap mating surfaces. The strap engaging structures and the locking piece engaging structure may in this manner define discrete positions (corresponding to discrete opening sizes of the strap arrangement) for the locking piece relative to the first strap portion for each strap engaging structure.

When the strap arrangement is to be closed, a user may tighten the second strap portion (this may or may not include stretching the second strap portion) and position the locking piece such that the locking piece engaging structure is in close, but not perfect, alignment with the strap engaging structure. The magnetic force forcing the locking piece engaging structure against this strap engaging structure will then bring the locking piece engaging structure into accurate alignment with the selected strap engaging structure that corresponds to a defined opening size of the strap arrangement.

Each strap engaging structure may comprise a ridge or peak and the locking piece engaging structure may comprise a valley adapted to mate with each ridge. Each ridge may be substantially parallel with a through axis of the opening of the strap arrangement. Also the valley may be substantially parallel with the through axis when the strap arrangement adopts any of the closed states.

In order to open this type of strap arrangement, a user may push the locking piece sideways (i.e. in a direction parallel with a through axis of the opening of the strap arrangement and in the width direction of the first and second strap portions), e.g. until the magnetic force is overcome, the locking piece is disengaged from the first strap portion and the second strap portion is allowed to be expanded.

As an alternative configuration, the first strap portion may comprise a recessed profile. The recessed profile may be limited in the width direction by two lateral flange portions. The lateral flange portions of the first strap portion may extend above the locking piece such that the locking piece is "countersunk" in the first strap portion. In this manner, the locking piece can be prevented from being disengaged sideways from the first strap portion 20.

The lateral flange portions may further comprise lateral indentations for mating with laterally profiles of the locking piece. A lateral direction within the present disclosure is a direction parallel with the through axis of the opening of the strap arrangement.

As a further possible configuration of strap engaging structures and locking piece engaging structure, each strap engaging structure may comprise a protruding pin and the locking piece engaging structure may comprise a hole (blind hole or through hole) or vice versa.

The angles of the ridges of each strap engaging structure and the angle of the valley of the locking piece engaging structure may be the same or substantially the same. The exact angles depend on the implementation, the number of strap engaging structures, the required force, the available magnetic force etc. The angles of the ridges and the valleys may for example be between 3° and 70°, such as 5° to 45°, such as 10° to 20°, such as approximately 15°. A flatter angle may be compensated by a stronger magnetic force. In case the angle is more acute, a reduced magnetic force can be used.

The locking piece may be an end piece of the second strap portion. The locking piece, the first strap portion and the second strap portion may have substantially the same width, e.g. dimension in a direction parallel with the through axis defined by the opening of the strap arrangement. According to an alternative variant, the locking piece and the first strap portion have substantially the same width and the second strap portion has a slightly smaller width. Alternatively, or in addition, the locking piece may have a width larger than the first strap portion.

The strap arrangement according to the present disclosure may further comprise a loop member having an opening wherein the second strap portion is positioned through the opening of the loop member. The second strap portion may thus pass through the opening of the loop member and be folded such that it at least overlaps itself. The loop member may be made of metal. Moreover, the loop member may be hingedly attached to, or relative to, a main body of a wearable device (e.g. a main body of a watch). Alternatively, the loop member may be integrally formed with the main body of a wearable device, for example by providing a through hole in an injection moulded main body.

As a further alternative, the strap arrangement may comprise a third strap portion attached to the main body of the wearable device. In this case, the loop member may interconnect the third strap portion with the second strap portion. For example, both the second strap portion and the third strap portion may be positioned through the opening of the loop member.

The locking piece may be blocked from passing through the opening of the loop member at least in some relative spatial orientations between the locking piece and the loop member. According to one variant, the locking piece may be larger than the opening of the loop member such that the locking piece can never pass therethrough, regardless of relative spatial orientation between the locking piece and the loop member.

According to an alternative variant, the locking piece and the loop member may be configured such that the locking piece is blocked from passing through the opening of the loop member in some relative spatial orientations (e.g. when the locking piece and the loop member are aligned) and such that the locking piece is allowed to pass through the opening of the loop member in at least one further relative spatial orientation (e.g. a relative inclined orientation). In this manner, it may be possible to completely disengage the second strap portion from the loop member.

The second strap portion may be connected to an end of the first strap portion. In this case, when the strap arrangement is in an engaged state, i.e. when the locking piece engaging structure is aligned with one of the strap engaging structures, the second strap portion may be folded such that it overlaps itself and overlaps a portion of the first strap portion.

The second strap portion may be hingedly connected to an end of the first strap portion. For this purpose, a hinge member may be provided. According to one variant, the hinge member is substantially T-shaped. The bottom of the T-shape may be hingedly attached to the first strap portion and the top of the T-shape may be rigidly secured to the second strap portion. The hinge member may be made of a rigid material, e.g. metal or hard plastics. The second strap portion may also be integral with the first strap portion, either constituted by the same material, or a different material joined together by welding, gluing, moulding etc.

Various possibilities for establishing the magnetic force to force the locking piece engaging structure against one of the strap engaging structures are conceivable. According to one variant, the at least one magnet may be a permanent magnet. Alternatively, or in addition, the at least one magnet may be an electromagnet. The at least one magnet may be provided in the locking piece. Alternatively, or in addition, the at least one magnet may be provided in the first strap portion.

According to one variant, the at least one magnet is constituted by a permanent magnet provided in the locking piece and a permanent magnet provided in the first strap portion. According to a further variant, the at least one magnet is constituted by a permanent magnet in the locking piece and an electromagnet in the first strap portion. According to a further variant, the at least one magnet is constituted by a permanent magnet in the locking piece and any magnetizable material (e.g. iron) in the first strap portion.

According to a further variant, the at least one magnet is constituted by an electromagnet in the locking piece and a permanent magnet in the first strap portion. According to a further variant, the at least one magnet is constituted by an electromagnet in the locking piece and an electromagnet in the first strap portion. According to a further variant, the at least one magnet is constituted by an electromagnet in the locking piece and a magnetizable material in the first strap portion.

According to a further variant, the at least one magnet is constituted by a magnetizable material in the locking piece and a permanent magnet in the first strap portion. According to a further variant, the at least one magnet is constituted by magnetizable material in the locking piece and an electromagnet in the first strap portion.

In case one or more electromagnets are employed, the electromagnets may provide a stronger magnetic force when actuated. In one variant, the electromagnets may be remotely activated/deactivated.

When a magnet or magnetizable material is provided in the locking piece, the locking piece may be entirely constituted by this material.

Alternatively, only a part of the locking piece may be constituted by a magnet or magnetizable material. For example, the magnet or magnetizable material may constitute a core of the locking piece and the core may be covered with another material, e.g. plastics. Such plastics may be injection moulded around the magnet or magnetizable material.

Similarly, when a magnet or magnetizable material is provided in the first strap portion, the first strap portion may be entirely constituted by this material. Alternative, only a part of the first strap portion may be constituted by a magnet or magnetizable material. For example, the magnet or magnetizable material may constitute a core of the first strap portion and the core may be covered with another material, e.g. plastics. Also the magnets or magnetizable material in the first strap portion may be covered with injection moulded plastics.

In case a magnet or magnetizable material is provided in the first strap portion, a magnet or magnetizable material may be provided adjacent to each strap engaging structure, i.e. associated with each strap engaging structure. That is, several magnets or magnetizable materials, for example corresponding to the discrete closed states of the strap arrangement, may be provided in the first strap portion. As an alternative, it is possible to provide one or more continuous magnets or magnetizable materials along the first strap portion that overlaps two or more strap engaging structures.

According to a further aspect, there is provided a wearable device comprising an electronic device and a strap arrangement according to the present disclosure. The wearable device may be adapted to be put on, worn on and removed from a body part of a user, e.g. a leg, an ankle, an arm (lower and upper arm), a finger, a wrist, or a waist (e.g. the wearable device may constitute a belt). Alternatively, the wearable device may be indirectly attached to the body part.

In case the locking piece comprises, or is constituted by, a magnet, the magnet may be used to trigger functions in the electronic device, for example by bringing the magnet in proximity to various areas of the electronic device when the strap arrangement is opened. Alternatively, or in addition, the wearable device may comprise one or several buttons to operate the electronic device.

In this manner, the magnet in the locking piece may perform one function when the strap arrangement is in the closed state (providing or increasing the magnetic force between the locking piece engaging structure against one of the strap engaging structures) and another function when the strap arrangement is in the open state (trigger one or more functions in the electronic device by bringing the locking piece in proximity to one or more sections of the electronic device).

An electronic device within the present disclosure may additionally employ NFC (Near Field Communication) communication or RFID (Radio Frequency Identification) technology. Electronics may also be provided in the first strap portion.

According to a further aspect, there is provided a fastener comprising a strap arrangement according to the present disclosure. The fastener may for example be constituted by an industry fastener. Also the fastener may comprise an electronic device according to the present disclosure.

The electronic device may be constituted by a watch, such as a fall detection watch. One example of a fall detection watch is described in European patent application 161856034.4.

A fall detection watch according to the present disclosure may be configured to measure at least one physiological parameter (e.g. blood oxygen saturation and/or heartrate) of a user wearing the wearable device. A fall detection watch according to the present disclosure may further be configured to predict a fall of the user, by comparing the measured at least one physiological parameter with at least one threshold, warn the user when a fall is predicted, receive an indication of a fall or of not a fall for the predicted fall, and adjust the threshold based on the received indication.

In case the electronic device is constituted by a fall detection watch, the electronic device may comprise only one button. This button may for example be associated with an alarm function. This solution is suitable for use by elderly or disabled patients wearing the fall detection watch due to its simplicity. In case the wearable device further comprises a magnet in the locking piece for triggering various functions of the electronic device by bringing the magnet adjacent to different areas of the electronic device, these functions may be of more advanced character and for example designed to be operated by medical staff in charge of the patient.

The electronic device may comprise a main body and the first strap portion may be integrally formed with the main body of the electronic device. As an alternative, the first strap portion may be attached to the main body of the electronic device. For these reasons, the first strap portion may alternatively be referred to as a main body strap portion. In case the first strap portion is attached to the main body of the electronic device, a hinge connection, e.g. by means of a metallic link, may be used.

In case the strap arrangement comprises a loop member, the loop member may be attached to the main body of the electronic device. In this case, the first strap portion and the second strap portions may constitute portions of one single strap or constitute distinct straps.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
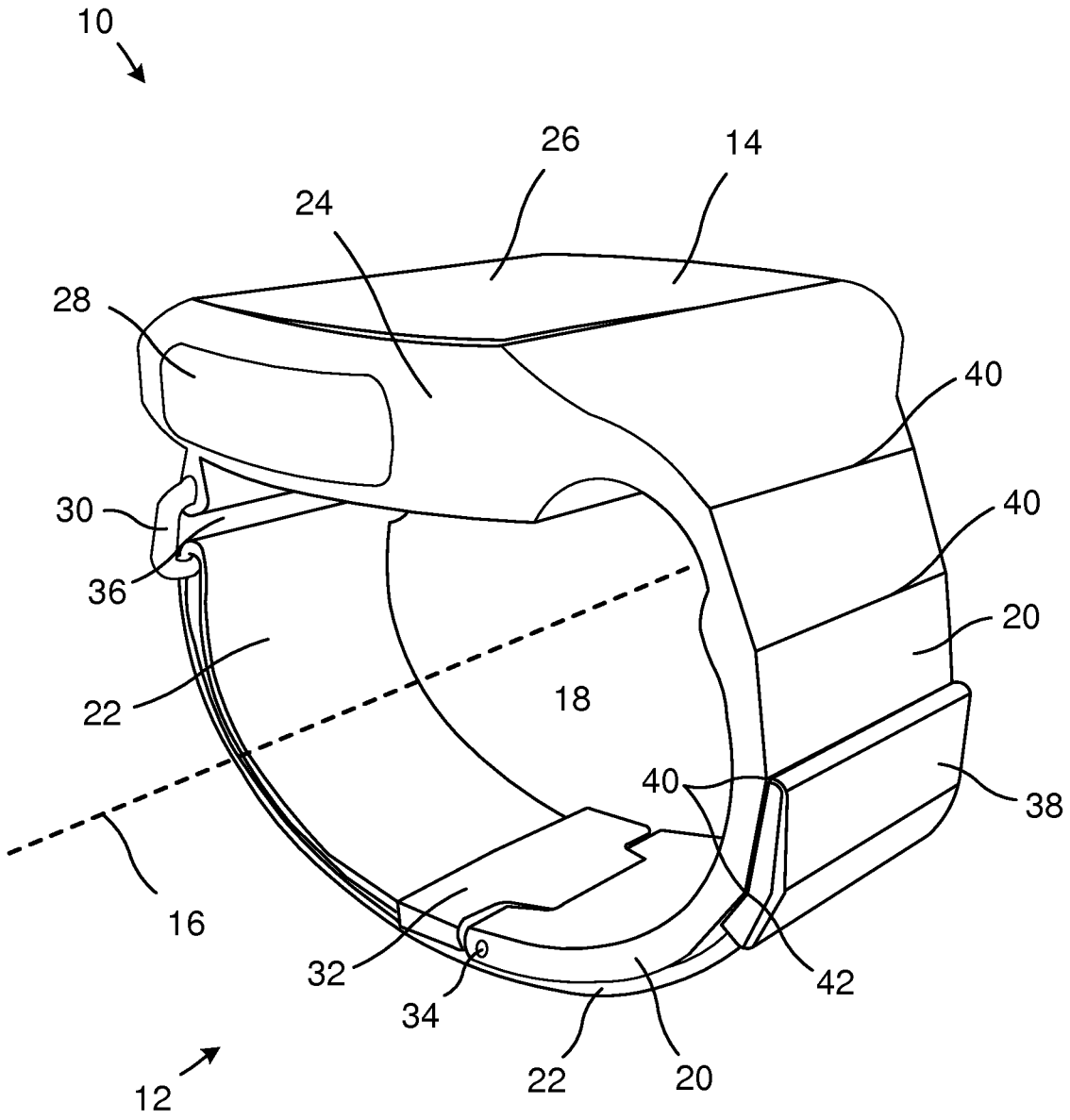
FIG. 1: schematically represents a perspective view of a wearable device comprising a strap arrangement.

In the following, a strap arrangement comprising a locking piece engaging structure, a plurality of strap engaging structures and a magnet for forcing the locking piece engaging structure against at least one of the strap engaging structure, and a wearable device comprising a electronic device and a strap arrangement, will be described. The same reference numerals will be used to denote the same or similar structural features.

Figure 2:
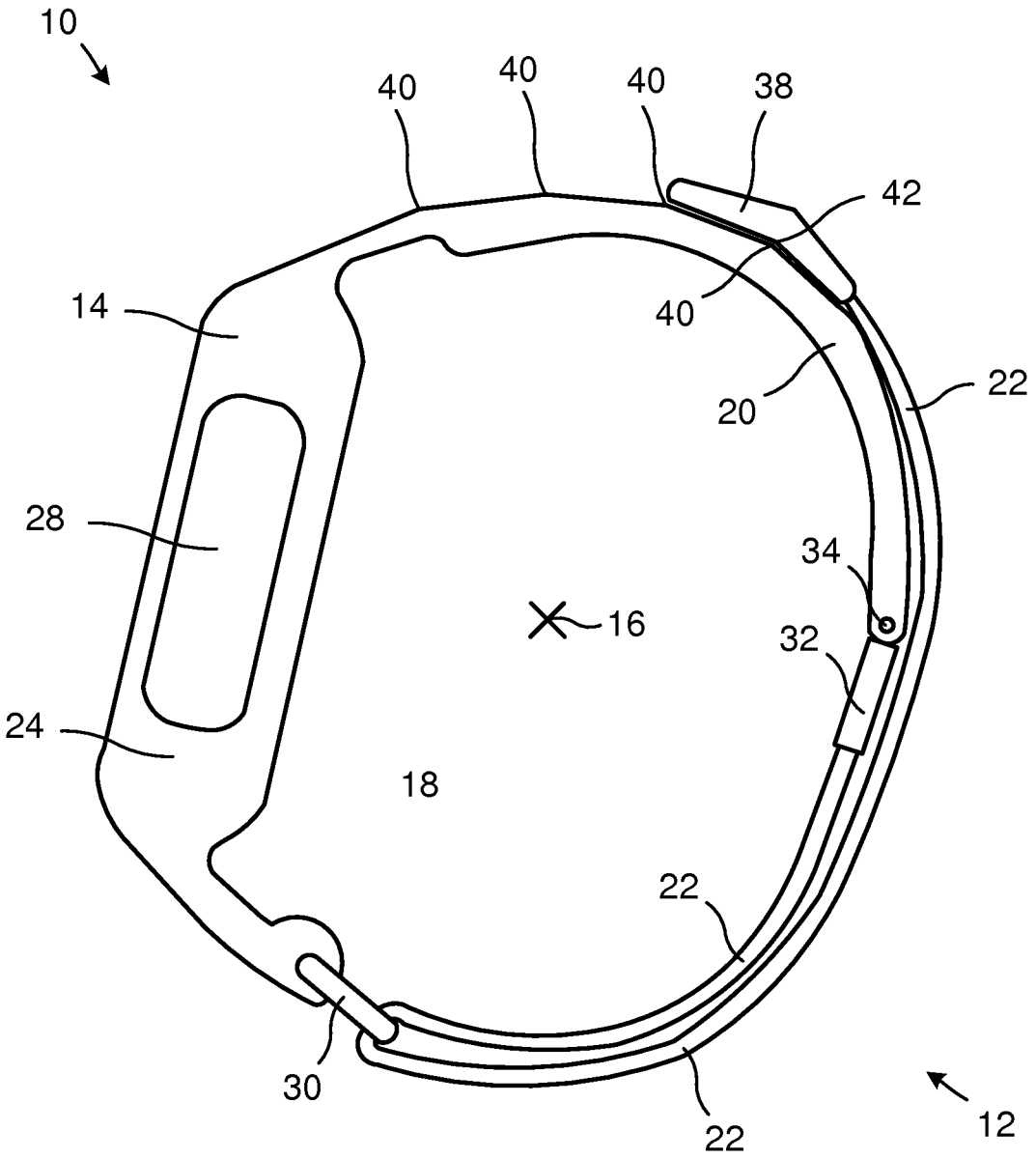
FIG. 2: schematically represents a side view of the wearable device in FIG. 1.

FIG. 1 schematically represents a perspective view of a wearable device 10 comprising a strap arrangement 12 and an electronic device 14. FIG. 2 schematically represents a side view of the wearable device 10. The side view in FIG. 2 is a view along a through axis 16 defined by an opening 18 of the strap arrangement 12 in FIG. 1.

With collective reference to FIGS. 1 and 2, the strap arrangement 12 is illustrated in one of several closed states. The implementation of the strap arrangement 12 in a wearable device 10 is merely exemplary, the strap arrangement 12 may be used in a number of alternative implementations, for example in an industrial fastener.

The strap arrangement 12 comprises a first strap portion 20 and a second strap portion 22. In this example, the first strap portion 20 is integrally formed with a main body 24 of the electronic device 14, for example by a common injection moulding process. The first strap portion 20 is thus substantially rigid. However, the first strap portion 20 may alternatively be made flexible and/or attached to the main body 24, e.g. via a hinge. The electronic device 14 of this non-limiting example is a fall detection watch and comprises a display 26 and a button 28 at a lateral side of the main body 24. The button 28 may for example be associated with an alarm function.

The second strap portion 22 is flexible and may for example be made of rubber, silicone rubber, textile or hinged or woven metal. In the illustrated position in FIG. 1, the second strap portion 22 is folded to overlap with itself and to overlap a part of the first strap portion 20 on the outer side.

The wearable device 10 further comprises a loop member 30 and a hinge member 32. The hinge member 32 is secured to one end of the second strap portion 22 and is hingedly connected to an end of the first strap portion 20 for rotation about a hinge axis 34. As can be seen in FIG. 1, the hinge axis 34 extends substantially parallel with the through axis 16 of the opening 18 defined by the strap arrangement 12. The hinge member 32 is here implemented as having a substantially T-shaped appearance where the bottom of the T-shape is connected to the hinge axis 34 (e.g. to a pin thereof) and the top of the T-shape is connected to the end of the second strap portion 22.

The loop member 30 comprises an opening 36 and is hingedly attached to the main body 24 of the electronic device 14. The loop member 30 may be made of metal.

In the closed state of the strap arrangement 12 in FIG. 1, the second strap portion 22 extends from the attachment to the end of the first strap portion 20 via the hinge member 32, through the loop member 30 back on the outside of the second strap portion 22 and to the outer side of the first strap portion 20. The second strap portion 22 comprises a locking piece 38 which in this example is provided at the distal end of the second strap portion 22.

The first strap portion 20 comprises a plurality of strap engaging structures 40. In this example, four strap engaging structures 40 are provided on an outer side of the first strap portion 20. Each strap engaging surface is constituted by a strap mating surface in the form of a ridge. Moreover, the locking piece 38 comprises a locking piece engaging structure 42 constituted by a locking piece mating surface in the form of a valley. As can be seen in FIG. 1, the ridges of the strap engaging structures 40 are directed radially outwardly and the valley of the locking piece engaging structure 42 is directed radially inwardly (with respect to the through axis 16). The ridges of the strap engaging structures 40 are parallel with the through axis 16 and extend over the entire width of the first strap portion 20.

Except for the strap engaging structures 40, the first strap portion 20 has smooth surfaces. Similarly, the locking piece 38 also has smooth surfaces except the radially inwardly pointing locking piece engaging structure 42 and a radially outwardly pointing ridge.

In FIG. 1, the locking piece engaging structure 42 is aligned with one of the four strap engaging structures 40 such that the strap arrangement 12 adopts one of four closed states.

The strap arrangement 12 further comprises at least one magnet (not shown) configured to force the locking piece engaging structure 42 against the strap engaging structure 40 by a magnetic force. As mentioned above, there are various alternative ways to establish a magnetic force to force the locking piece engaging structure 42 against the strap engaging structure 40.

As one non-limiting example, a permanent magnet may be provided in the locking piece 38 (or the locking piece 38 may be constituted by a permanent magnet) and an electromagnet may be arranged in the first strap portion 20. The magnet of the locking piece 38 may attract the magnet in the first strap portion 20. The magnetic force may be established only when the electromagnet in the first strap portion 20 is activated, or the magnetic force may be stronger when the electromagnet is activated. The magnet in the locking piece 38 or the electromagnet in the first strap portion 20 may be replaced with any type of magnetizable material (e.g. iron).

The strap engaging structures 40 and the locking piece engaging structure 42 together define discrete positions for the locking piece 38 relative to the first strap portion 20. In case the locking piece 38 is manually positioned "inaccurately" with respect to one of these positions, the magnetic force may pull the locking piece 38 into a more precise position. The strap engaging structures 40 and the locking piece engaging structure 42 also prevent the locking piece 38 from sliding along an outer profile of the first strap portion 20, i.e. in the circumferential direction of the first strap portion 20.

In order to open the strap arrangement 12 (either to remove the wearable device 10 or to adjust the size of the opening 18 of the strap arrangement 12), the user may simply push the locking piece 38 (possibly after deactivating any electromagnet) sideways in a lateral or width direction of the first strap portion 20 until the locking piece 38 is disengaged from the first strap portion 20. Once the locking piece 38 is disengaged from the first strap portion 20, the second strap portion 22 may be pushed or pulled through the opening 36 of the loop member 30 until the opening 18 is sufficiently large for removing the wearable device 10 from the user (or other object). The locking piece 38 is larger than the opening 36 of loop member 30 such that the locking piece 38 is blocked from passing through the loop member 30. In this way, the second strap portion 22 is prevented from being entirely released from the loop member 30. However, the locking piece 38 and the loop member 30 may be designed such that the locking piece 38 can pass through the opening 36 if desired, e.g. by tilting the locking piece 38.

This opening procedure is simple and may be carried out with one hand of the user. In a corresponding closing procedure, the user can also attach the wearable device 10 to the user (or other object) with one hand. The user can first put his hand through the opening 18, then hang the first strap portion 20 of the wearable device 20 on his arm, then release the grip, grab the locking piece 38, pull until the desired opening size is reached and lock by aligning the locking piece 38 with any of the strap engaging structures 40 on the first strap portion 20.

Figure 3:
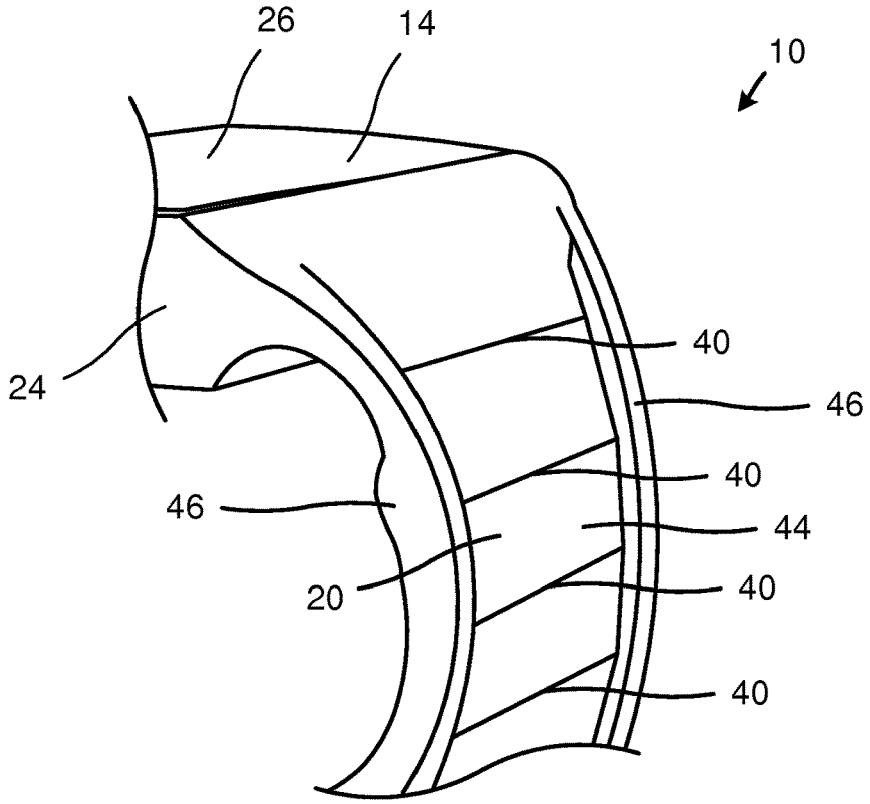
FIG. 3: schematically represents a partial perspective view of a further wearable device.
Figure 4:
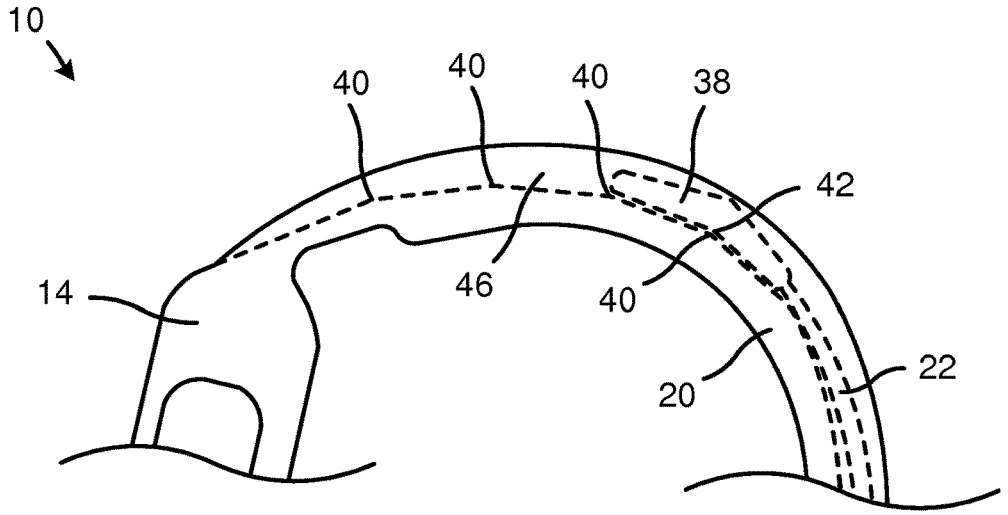
FIG. 4: schematically represents a partial side view of the wearable device in FIG. 3.

FIG. 3 schematically represents a partial perspective view of a further wearable device 10 and FIG. 4 schematically represents a partial side view of the wearable device in FIG. 3. Mainly differences with respect to FIGS. 1 and 2 will be described. The first strap portion 20 in FIGS. 3 and 4 comprises a recessed profile 44. The recessed profile 44 faces radially outwardly and is limited in each lateral direction (width direction) by a lateral flange portion 46.

As can be seen in FIG. 4, the lateral flange portions 46 extend above (further outwardly in the radial direction) the height of the locking piece 38. In other words, the locking piece 38 is in this example lowered into the first strap portion 20. In this manner, the locking piece 38 does not extend above the first strap portion 20. As an alternative, the locking piece 38 extends only partially (e.g. with 10% or 20%) above the first strap portion 20.

The configuration in FIGS. 3 and 4 prevents the locking piece 38 from being disengaged sideways from the first strap portion 20, i.e. in the lateral direction.

Figure 5:
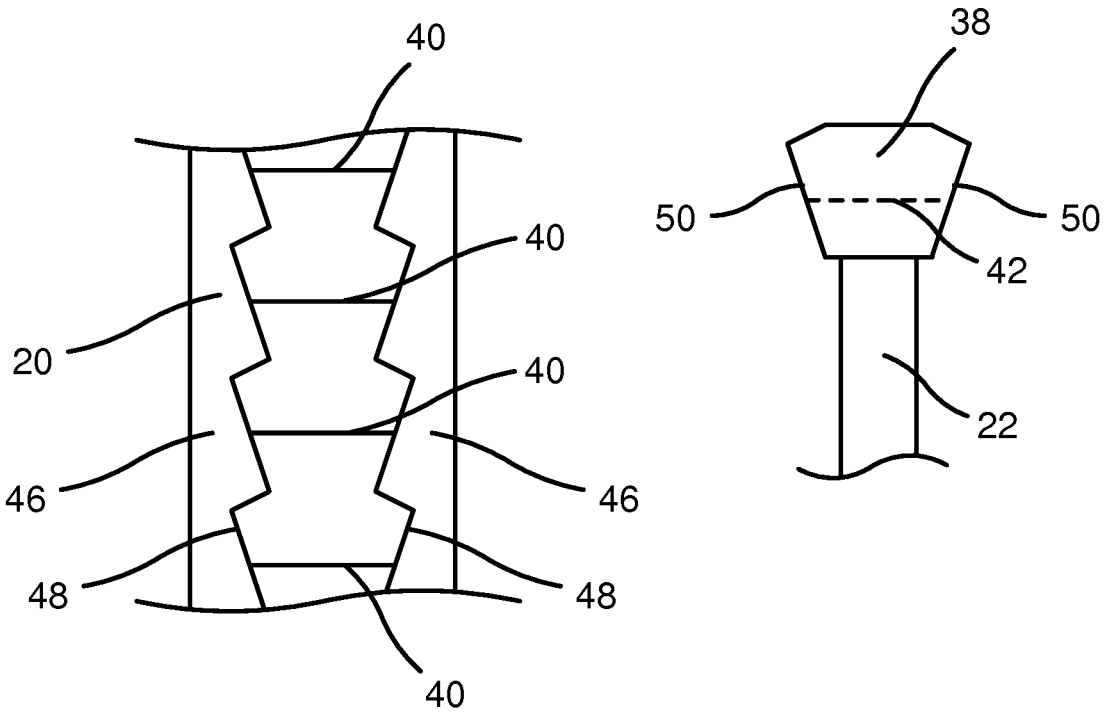
FIG. 5: schematically represents a partial front view of a first strap portion and a second strap portion.

FIG. 5 schematically represents a partial front view of a first strap portion 20 and a second strap portion 22 according to a further development of the configuration in FIGS. 3 and 4. In the example of FIG. 5, the lateral flange portions 46 of the first strap portion 20 are provided with lateral indentations 48. The locking piece 38 of this example is provided with lateral profiles 50 configured to mate with any of the lateral indentations 48 when the locking piece engaging structure 42 of the locking piece 38 is aligned with one of the strap engaging structures 40 of the first strap portion 20. Also in the examples of FIGS. 3 to 5, the strap engaging structures 40 are implemented as ridges and the locking piece engaging structure 42 is implemented as a valley.

While the present disclosure has been described with reference to exemplary embodiments, it will be appreciated that the present invention is not limited to what has been described above. For example, it will be appreciated that the dimensions of the parts and the moving speeds may be varied as needed. Accordingly, it is intended that the present invention may be limited only by the scope of the claims appended hereto.

The invention claimed is:

1. A strap arrangement comprising:

a first strap portion comprising a plurality of strap engaging structures, each strap engaging structure defines a size of an opening of the strap arrangement;

a flexible second strap portion comprising at least one locking piece, the locking piece comprising at least one locking piece engaging structure for being aligned with at least one of the strap engaging structures;

at least one magnet adapted to force the locking piece engaging structure against at least one of the strap engaging structures by a magnetic force; and a loop member having an opening wherein the second strap portion is positioned through the opening of the loop member;

wherein each strap engaging structure comprises a ridge and the locking piece engaging structure comprises a valley adapted to mate with each ridge;

wherein each ridge is substantially parallel with a through axis of the opening of the strap arrangement;

wherein the angles of the ridges and the valleys are between 3° and 70°; and wherein the locking piece is blocked from passing through the opening of the loop member at least in some relative spatial orientations between the locking piece and the loop member.

2. The strap arrangement according to claim 1, wherein the strap engaging structures are constituted by strap mating surfaces and the locking piece engaging structure is constituted by a locking piece mating surface adapted to mate with at least one of the strap mating surfaces.

3. The strap arrangement according to claim 1, wherein the locking piece is an end piece of the second strap portion.

4. The strap arrangement according to claim 1, wherein the second strap portion is connected to an end of the first strap portion.

5. The strap arrangement according to claim 1, wherein the at least one magnet is a permanent magnet.

6. The strap arrangement according to claim 1, wherein the at least one magnet is an electromagnet.

7. The strap arrangement according to claim 1, wherein the at least one magnet is provided in the locking piece.

8. The strap arrangement according to claim 1, wherein the at least one magnet is provided in the first strap portion.

9. A wearable device comprising an electronic device and a strap arrangement according to claim 1.

10. The wearable device according to claim 9, wherein the electronic device is a watch, such as a fall detection watch.

11. The wearable device according to claim 9, wherein the electronic device comprises a main body and the first strap portion is integrally formed with the main body of the electronic device.

12. The strap arrangement according to claim 1, wherein the angles of the ridges and the valleys are between 5° and 45°.

13. The strap arrangement according to claim 1, wherein the angles of the ridges and the valleys are between 10° and 20°.

14. The strap arrangement according to claim 1, wherein the angles of the ridges and the valleys are 15°.

* * * * *